United States Patent [19]

Svantesson

[11] 4,408,644

[45] Oct. 11, 1983

[54] DRINKING CUP

[75] Inventor: Gustav I. Svantesson, Vårgårda, Sweden

[73] Assignee: Svantesson & Andersson Mekaniska (SAMEK) AB, Vårgårda, Sweden

[21] Appl. No.: 328,708

[22] Filed: Dec. 8, 1981

[51] Int. Cl.[3] ..... A47G 19/22

[52] U.S. Cl. ..... 150/55; 229/1.5 B

[58] Field of Search ..... 150/0.5; 229/1.5 B

[56] References Cited

FOREIGN PATENT DOCUMENTS 7800287 9/1979 Sweden ..... 150/0.5

*Primary Examiner*—Donald F. Norton

*Attorney, Agent, or Firm*—Cushman, Darby & Cushman

[57] ABSTRACT

The invention concerns a drinking cup intended for repeated use. The cup is manufactured from a resilient and flexible plastics material.

The cup comprises a lower cylindrical section, a thinner middle section, and an upper section which essentially has the shape of a truncated cone. The walls of this cone-shaped section may converge upwards. The upper section may be folded downwards, into the lower section, the middle section serving as the folding line.

A handle is provided at the upper cup section. In the area where the handle is provided the upper section has a straight portion which imparts to the upper cup section a slightly oval shape, serving to make it easier to drink from the cup. In addition, the handle is formed at a rigid area of the upper section, whereby folding downwards of the upper section into the lower section is made easier.

6 Claims, 6 Drawing Figures

DRINKING CUP

BACKGROUND OF THE INVENTION

The subject invention concerns improvements to a drinking cup of a kind which is manufactured from a resilient, flexible synthetic resin material and which is intended for repeated use.

On various occasions, expandable cups are used for coffee and other beverages, either for convenience or because no service personnel is available for washing up. The extensive use of expendable articles of this kind has been widely discussed lately. The critics claim that the use of expendable articles is a considerable waste of natural resources and energy and often leads to environmental pollution.

In Swedish Pat. 409 645 granted Dec. 20, 1979 is disclosed a cup intended for use on the occasions outlined above. This cup, which is manufactured from a resilient and flexible synthetic resin material and which is intended for repeated use, has a lower, preferably cylindrical section, and an upper section essentially in the shape of a truncated cone, which cone-shaped section may be turned downwards and folded upon the lower section to reduce the volume of the cup.

Cups of this kind suffer from certain drawbacks. The round shape make them difficult to drink from. On account of the comparatively weak structure of such cups in the area of the handle, folding of the upper section downwards as well as raising the section involves certain difficulties.

Another known constructions for similar purposes is the collapsible tumbler. The tumbler consists of several parts which are slidable into each other. These parts can be locked relative to one other in a position in which the tumbler serves as a drinking cup and be folded together to a compact position. The main disadvantage inherent in this construction is leakage of the cup due to the wear between the parts.

SUMMARY OF THE INVENTION

The purpose of the subject invention is to provide a cup which is intended for repeated use and which at the same time is durable, easy to carry and has a shape that makes the cup ideal to drink from.

The cup, which has a handle at the upper section thereof, is characterised in that it comprises an essentially straight portion, in the area where said handle is provided, and that said handle is provided at a rigid portion of said upper section of the cup.

When folded, the cup forms a neat and compact unit which is easy to carry. For instance, when carried in the pocket of a jacket it does not cause the pocket to bulge to reveal its presence.

Because of its compactness when folded, the cup in accordance with the invention is highly suitable for use in hiking, fishing, hunting and on similar occasions when it is convenient to bring along a drinking utensil of some kind. The various kinds of drinking mugs available for such outdoor uses are considerably more bulky than the cup in accordance with the invention. Indeed, the design of the cup in accordance with the invention is such that it may be advantageously used whenever compactness is required and space or storage room is limited, such as on travels, onboard boats, etcetera.

BRIEF DESCRIPTION OF THE DRAWINGS

The invention will be described in closer detail in the following with reference to the accompanying drawings showing two embodiments of the cup. In the drawings

DETAILED DESCRIPTION OF A PREFERRED EMBODIMENT

Figure 1:
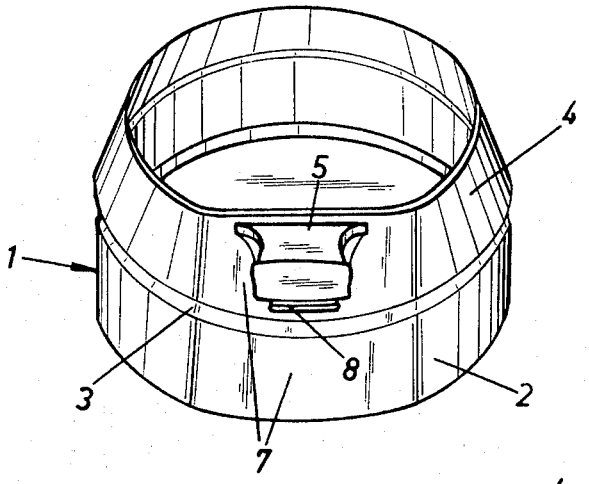
FIG. 1 is a perspective view of a cup in accordance with a first embodiment, the cup being shown in the drinking position, in which the upper cup section is raised.

The cup, which is generally designated by reference 1, is formed as one integral piece from a resilient and flexible synthetic resin material. The cup consists of a lower section 2 which in accordance with the first embodiment shown is essentially cylindrical, a middle section 3, and an upper section 4, the latter projecting convergingly upwards from the middle section. The cup also is provided with a handle 5.

Figure 2:
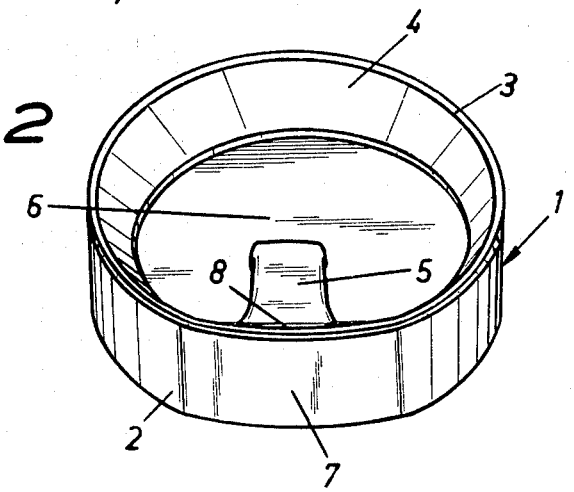
FIG. 2 is a perspective view of the cup of FIG. 1 in the storage position, in which the upper section is folded downwards.
Figure 3:
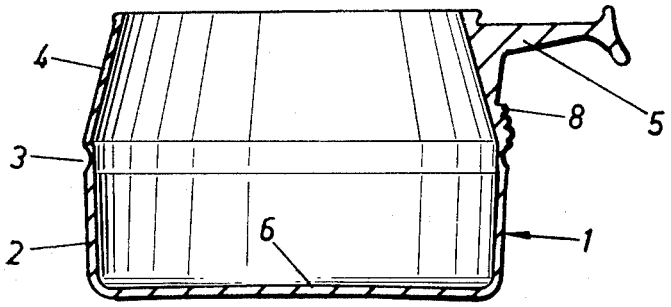
FIG. 3 is a sectional view through the cup of FIG. 1.

The middle section 3 is thinner than the other two sections of the cup, which appears most clearly from FIG. 3. The middle section 3 serves as the cup folding line. By pressing the upper section 4 of the cup downwards, into the cup interior, the upper cup section may be folded along the middle section 3 upon the lower section from the drinking position illustrated in FIG. 1 to the storage position illustrated in FIG. 2, in which latter position the entire upper section 4 as well as the handle 5 are accommodated inside the lower cylindrical space of the cup.

As appears from FIG. 3 the bottom 6 of the cup is not completely straight but extends in a slight dome-shape from the edges towards the centre. The dome-shape configuration of the cup ensures that the cup may rest firmly on a supporting face.

Figure 4:
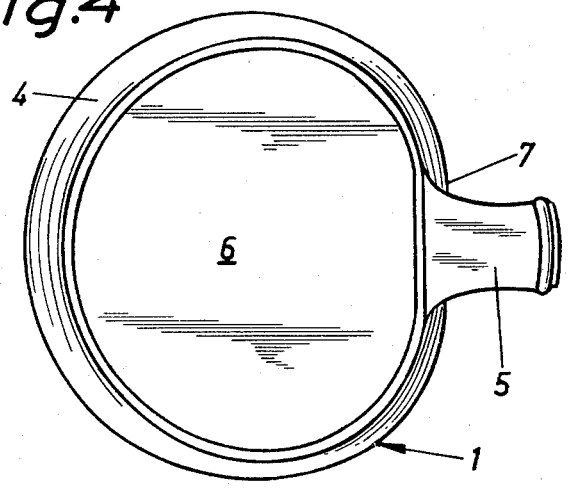
FIG. 4 is a plan view of the cup of FIG. 1.

In the area where the handle 5 is provided, a part 7 of the cup is essentially straight. This straight part 7 of the cup, imparts to the cup a slightly oval shape (see FIG. 4). This oval shape makes the cup rather more easy to drink from than a completely round shape would. The handle 5 is provided at a part of the cup that is rigid and preferably the area adjacent this part where the handle 5 is provided is more rigid than the remaining part of the upper section 4 of the cup. The rigidity at the handle-provision area makes possible the configuration of the straight part 7, which in turn contributes to making the folding of the upper section of the cup downwards easier than it would have been, had the cup had the same rigidity as the rest of the cup and a round-shaped upper section. This is so because the cup is intended to be folded by pressing down the upper section from opposite sides of the cup.

The cup 1 in accordance with the embodiment shown in FIGS. 1–4 is provided in the area underneath the handle with embossments or beads 8 serving to reduce the risk that the user burns his hands on the heat from hot beverages in the cup.

Figure 5:
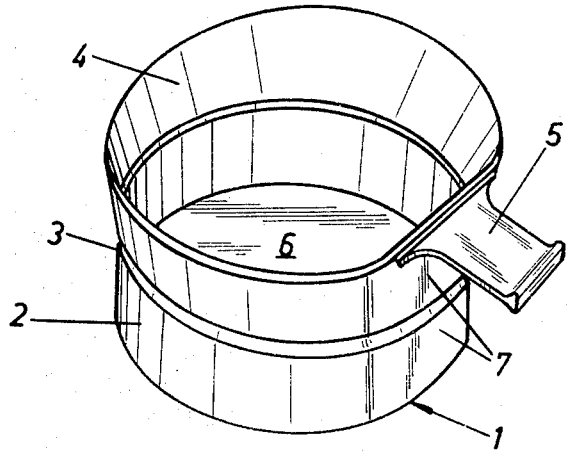
FIG. 5 is a perspective view of a cup in accordance with a second embodiment of the cup, showing the latter in the raised drinking position.
Figure 6:
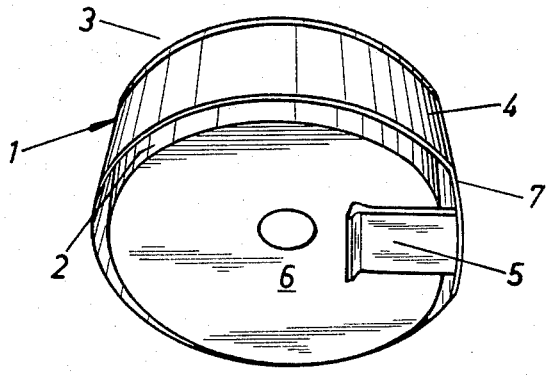
FIG. 6 shows the cup of FIG. 5 in the folded storage position.

To describe the embodiment illustrated in FIGS. 5 and 6 the same reference numerals have been used as for corresponding details of the first embodiment shown in FIGS. 1-4. In accordance with the second embodiment, the upper cup section 4 diverges upwards. As appears form FIG. 6 the upper section 4 may be folded downwards externally of the lower cylindrical section 2.

Compared with the embodiment in FIGS. 5 and 6, the embodiment in accordance with FIGS. 1-4 is advantageous in that in case a small amount of liquid remains inside the cup, this liquid is trapped within the cup when the latter is folded.

The invention is not limited to the embodiment described in the aforegoing but several modifications are possible within the scope of the appended claims. More than one upper section can be provided.

When the cup is made from sufficiently pliable plastics it is not necessary to provide the cup with a thinner middle section serving as a folding line.

What I claim is:

1. An improved drinking cup manufactured from a resilient and flexible synthetic resin material and intended for repeated use, comprising a lower section, at least one upper section, said upper section being essentially in the shape of a truncated cone which cone-shaped section may be turned downwards and folded upon the lower section to reduce the volume of the cup, and a handle, said handle provided on said upper section of the cup, the improvement comprising an essentially straight portion in the upper section of the cup adjacent the handle, said straight portion imparting to the upper section a slightly oval shape serving to facilitate drinking from the cup and a rigid portion of said upper section of the cup, said handle formed at said rigid portion.

2. An improved drinking cup as claimed in claim 1, comprising a middle section interconnecting said upper cup section and said lower cup section, said middle section being thinner than the other cup sections and serving as a folding line when said upper cup section is folded upon said lower cup section.

3. An improved drinking cup as claimed in claim 1, comprising beads in the cup area beneath said handle.

4. An improved drinking cup as claimed in claim 1, wherein said upper section of said cup diverges in an upwards direction, said upwardly diverging upper cup section being foldable downwards over the exterior face of said lower cup section.

5. A reusable drinking cup manufactured from resilient and flexible synthetic resin material, said cup comprising a peripheral wall having a lower section and an upper section, said upper section having generally the shape of a truncated cone and capable of being turned downwardly relative to said lower section so as to be folded upon said lower section to reduce the volume of the cup, the peripheral wall of said upper portion having an essentially straight portion imparting to said upper section a slightly oval shape, said essentially straight portion having a handle protruding therefrom the area of said straight portion adjacent said handle being more rigid than the remaining portion of said upper section.

6. A cup as in claim 5 wherein said lower section is cylindrical.

* * * * *